US007017325B2

(12) United States Patent
Weder

(10) Patent No.: US 7,017,325 B2
(45) Date of Patent: Mar. 28, 2006

(54) APPARATUS FOR FORMING AND SECURING A DECORATIVE COVER ABOUT A FLOWER POT

(75) Inventor: Donald E. Weder, Highland, IL (US)

(73) Assignee: Wanda M. Weder and William F. Straeter, Highland, IL (US), not individually but solely as Trustees of The Family Trust U/T/A dated December 8, 1995

( * ) Notice: Subject to any disclaimer, the term of this patent is extended or adjusted under 35 U.S.C. 154(b) by 0 days.

(21) Appl. No.: 10/735,981

(22) Filed: Dec. 15, 2003

(65) Prior Publication Data

US 2005/0126131 A1 Jun. 16, 2005

(51) Int. Cl.
*B65B 49/00* (2006.01)
*B65B 11/00* (2006.01)

(52) U.S. Cl. ..... 53/582; 53/138.6; 53/176; 53/218

(58) Field of Classification Search ..... 53/585, 53/526, 582, 138.6, 139.4, 176, 218, 219, 53/221, 370.6
See application file for complete search history.

(56) References Cited

U.S. PATENT DOCUMENTS 1,484,050 A * 2/1924 Zimmerman ..... 29/235.5
2,236,936 A 4/1941 Camp
2,514,038 A * 7/1950 Doolittle ..... 53/138.1
2,924,926 A * 2/1960 Paine, Jr. ..... 53/138.1
3,974,762 A * 8/1976 Kita et al. ..... 100/9
4,127,978 A * 12/1978 Lucke ..... 53/585
4,280,314 A 7/1981 Stuck
4,442,765 A * 4/1984 Limehouse et al. ..... 100/6
4,470,241 A 9/1984 Parry et al.
4,480,536 A * 11/1984 Burns ..... 100/6

(Continued)

FOREIGN PATENT DOCUMENTS

GB 2088812 A 6/1982

*Primary Examiner*—Stephen F. Gerrity
*Assistant Examiner*—Paul Durand
(74) *Attorney, Agent, or Firm*—Dunlap, Codding & Rogers, P.C.

(57) ABSTRACT

A method and apparatus for forming a decorative cover about an outer peripheral surface of a flower pot. The apparatus includes a frame assembly having a well formed therein, and a cover forming and banding assembly having a flower pot receiving opening sized and configured to receive at least a portion of a sheet of cover forming material and at least a lower portion of the flower pot. The platform is provided with an opening therein sized to permit passage of at least a portion of the flower pot and at least a portion of the sheet of cover forming material there through. The cover forming and banding assembly is supported within the well of the frame such that the flower pot receiving opening in the cover forming and banding assembly is aligned with the opening in the platform. The cover forming and banding assembly sports at least one band thereon such that upon forming the decorative cover about an outer peripheral surface of the flower pot by positioning the flower pot and at least a portion of the sheet of cover forming material within the pot receiving opening of the cover forming and banding assembly, the decorative cover so formed can be secured about the outer peripheral surface of the flower pot by removing at least one band from the cover forming and banding assembly and positioning the at least one band about the decorative cover.

6 Claims, 8 Drawing Sheets

U.S. PATENT DOCUMENTS

| | | | | |
|---|---|---|---|---|
| 4,555,893 | A | 12/1985 | Nakata et al. | |
| 4,570,415 | A | 2/1986 | Centeno | |
| 4,640,079 | A | 2/1987 | Stuck | |
| 5,417,033 | A | 5/1995 | Weder | |
| 5,426,914 | A | 6/1995 | Weder et al. | |
| 5,473,858 | A | 12/1995 | Hayes | |
| 5,531,058 | A | 7/1996 | Weder | |
| 5,588,277 | A * | 12/1996 | Weder et al. | 53/399 |
| 5,921,060 | A * | 7/1999 | Straeter | 53/176 |
| 6,178,727 | B1 * | 1/2001 | Weder et al. | 53/580 |
| 6,502,368 | B1 * | 1/2003 | Grether | 53/399 |
| 2005/0016136 | A1 * | 1/2005 | Weder | 53/592 |

* cited by examiner

APPARATUS FOR FORMING AND SECURING A DECORATIVE COVER ABOUT A FLOWER POT

FIELD OF THE INVENTION

The present invention relates generally to a method and apparatus for securing a decorative cover about an outer peripheral surface of a flower pot. In one aspect, the present invention relates to a method and apparatus for forming a decorative cover about an outer peripheral surface of a flower pot such that an open upper end of the flower pot remains substantially uncovered, and applying a band about the decorative cover for securing the decorative cover about the outer peripheral surface of the flower pot while the flower pot with the decorative cover is supported in the apparatus.

DESCRIPTION OF PREFERRED EMBODIMENTS

Figure 1:
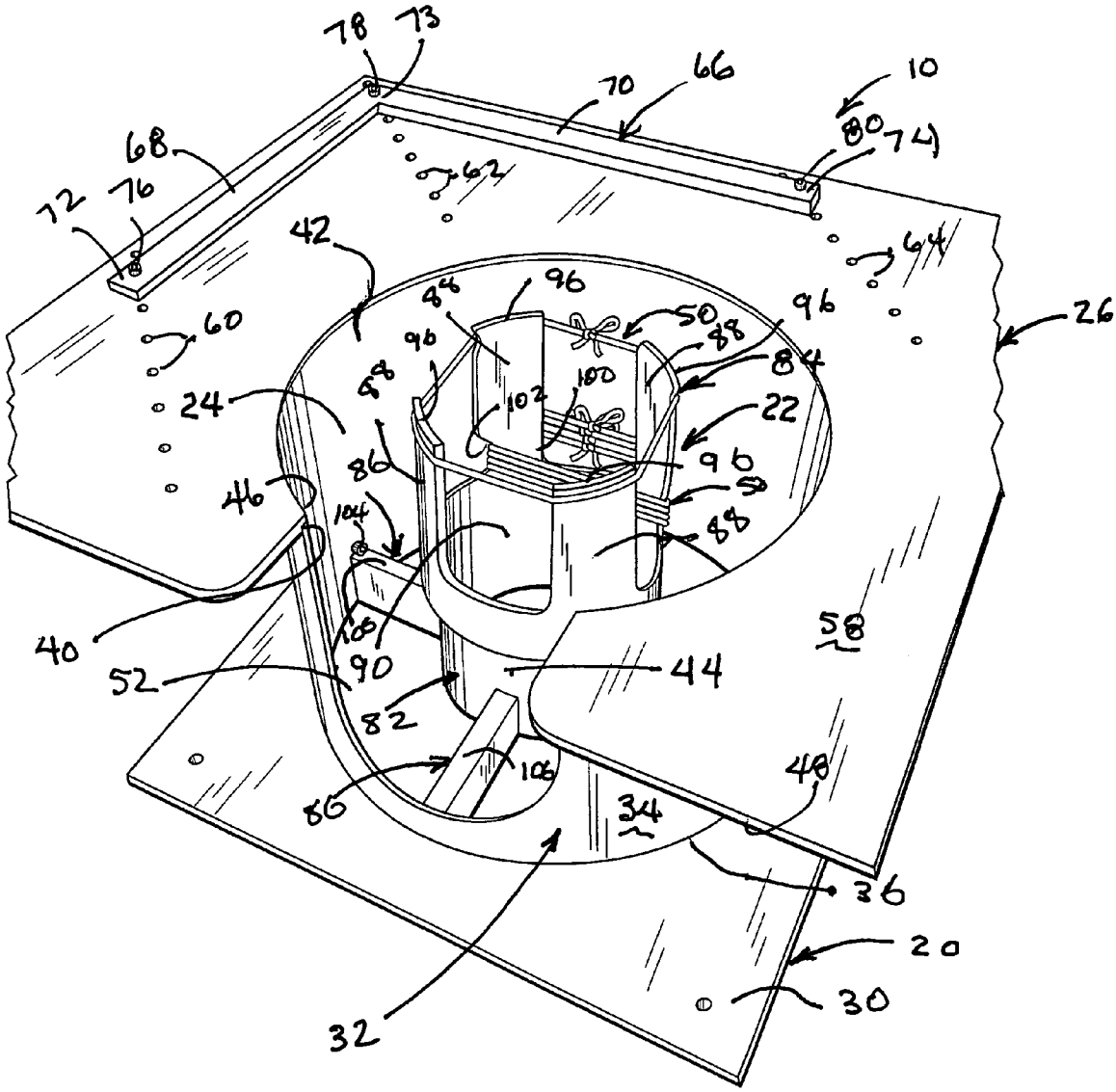
FIG. 1 is a partially broken perspective view of an apparatus constructed in accordance with the present invention for forming and securing a decorative cover about an outer peripheral surface of a flower pot.
Figure 2:
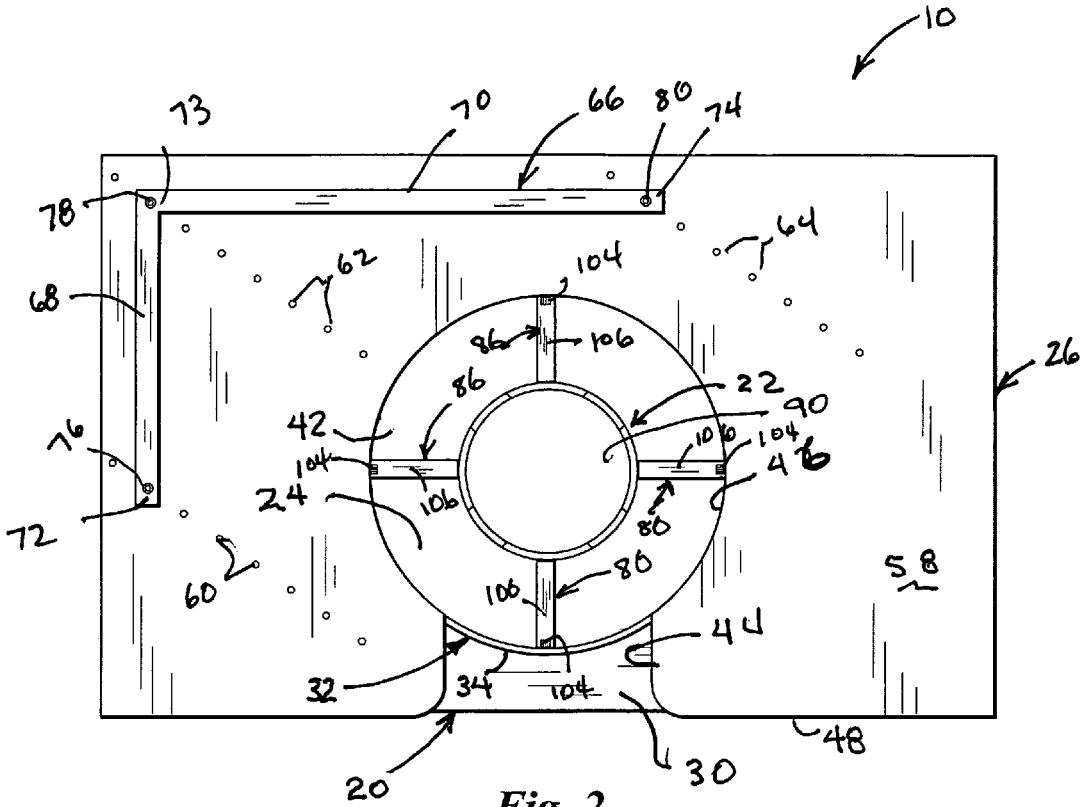
FIG. 2 is a top plan view of a frame assembly of the apparatus of the present invention having a cover forming and banding apparatus supported in a well of the frame assembly.
Figure 9:
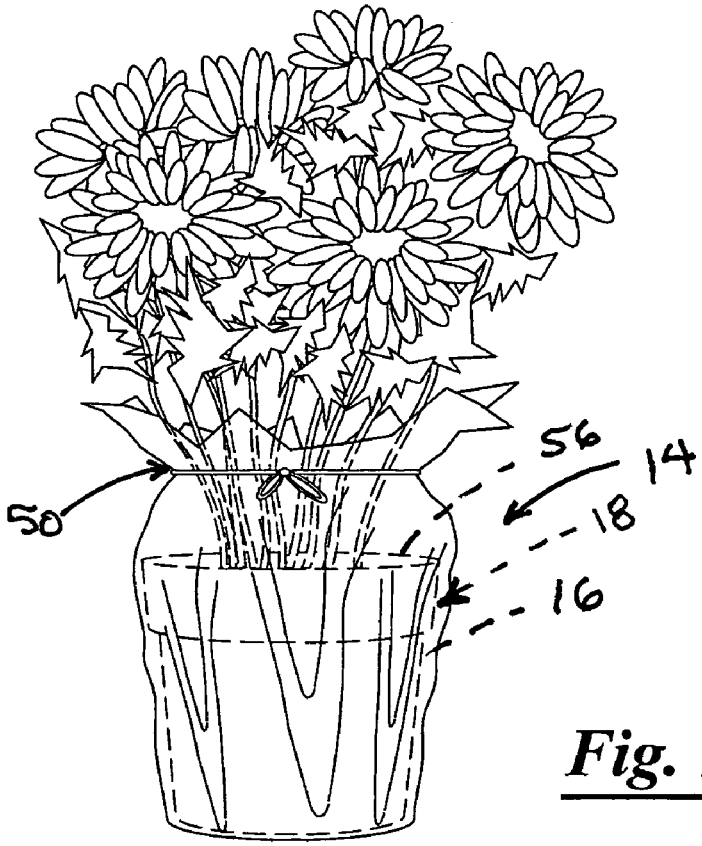
FIG. 9 is perspective view of the decorative cover disposed about an outer peripheral surface of the flower pot wherein the decorative cover is secured about the flower pot by a band disposed above an upper rim of the flower pot.
Figure 10:
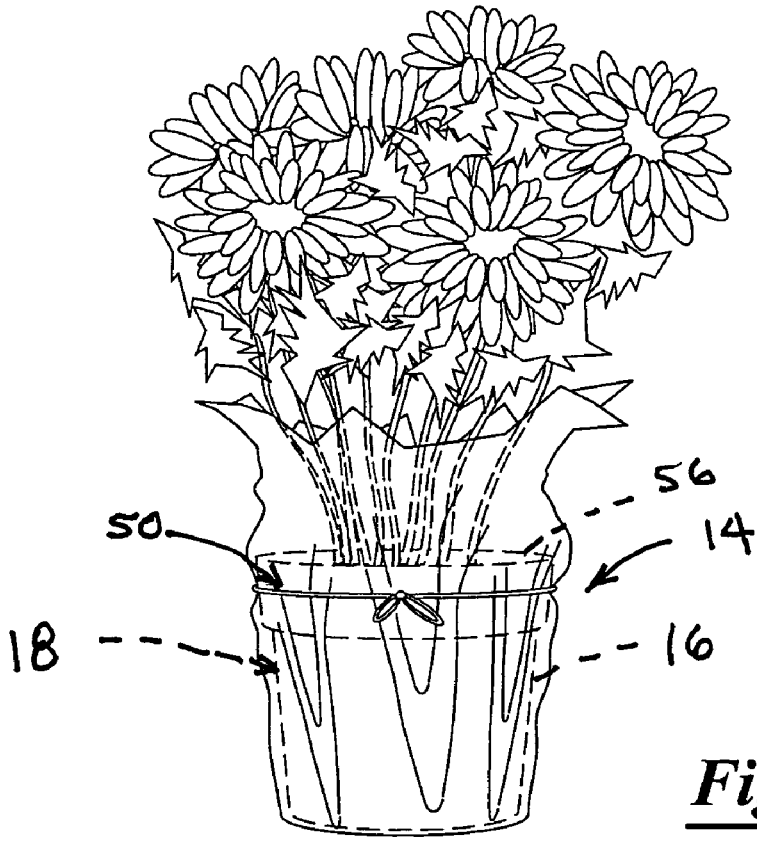
FIG. 10 is a perspective view of the decorative cover disposed about the outer peripheral surface of the flower pot wherein the decorative cover is secured about the flower pot by a band disposed below the upper rim of the flower pot.

Referring now to the drawings, and more particularly to FIGS. 1 and 2, shown therein and designated by the general reference number 10 is an apparatus for forming and securing a decorative cover 14 about an outer peripheral surface 16 of a flower pot 18 (FIGS. 9 and 10). The apparatus 10 includes a frame assembly 20, a cover forming and banding assembly 22 supported in a well 24 of the frame assembly 20 and a platform 26 sized and configured to receive and support a sheet of cover forming material 28 (FIG. 6) used to form the decorative cover 14 about the outer peripheral surface 16 of the flower pot 18. As will be more fully described herein after, the design and configuration of the cover forming and banding assembly 22 may provide controlled pleats in the decorative cover 14 and/or reduce distortion of printed patterns in the decorative cover 14.

Referring now to FIGS. 1, 2, and 5–7, the frame assembly 20 of the apparatus 10 includes a base plate 30 and a housing 32 having a peripheral sidewall 34. The base plate 30 is connected to a lower or first end 36 of the housing 32 such that at least a portion of the base plate 30 cooperates with the housing 32 to define the well 24 of the frame assembly 20.

Figure 3:
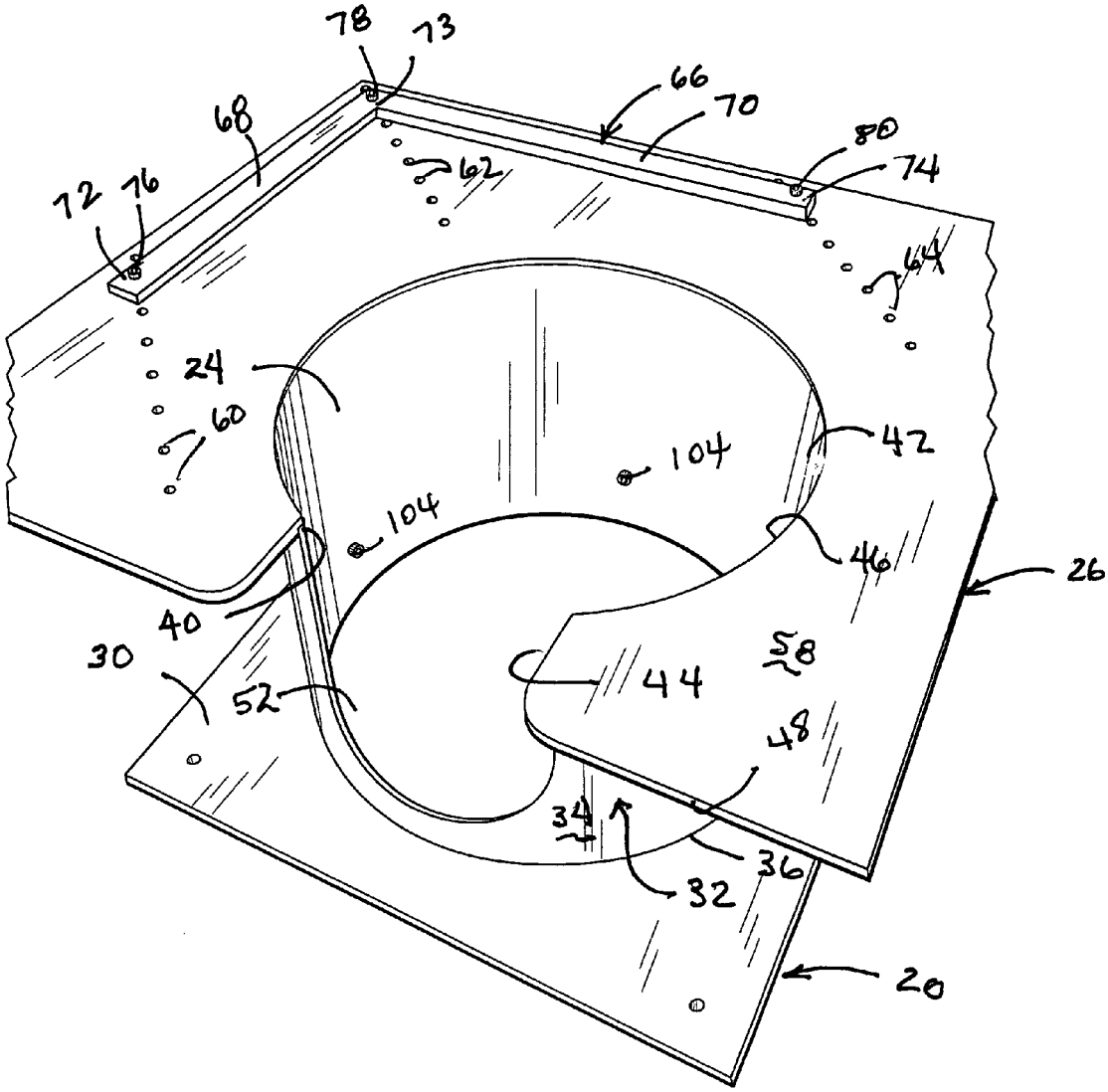
FIG. 3 is a partially broken perspective view of the apparatus of FIG. 1 having the cover forming and banding apparatus removed therefrom to more clearly illustrate the well of the frame assembly of the apparatus.
Figure 4:
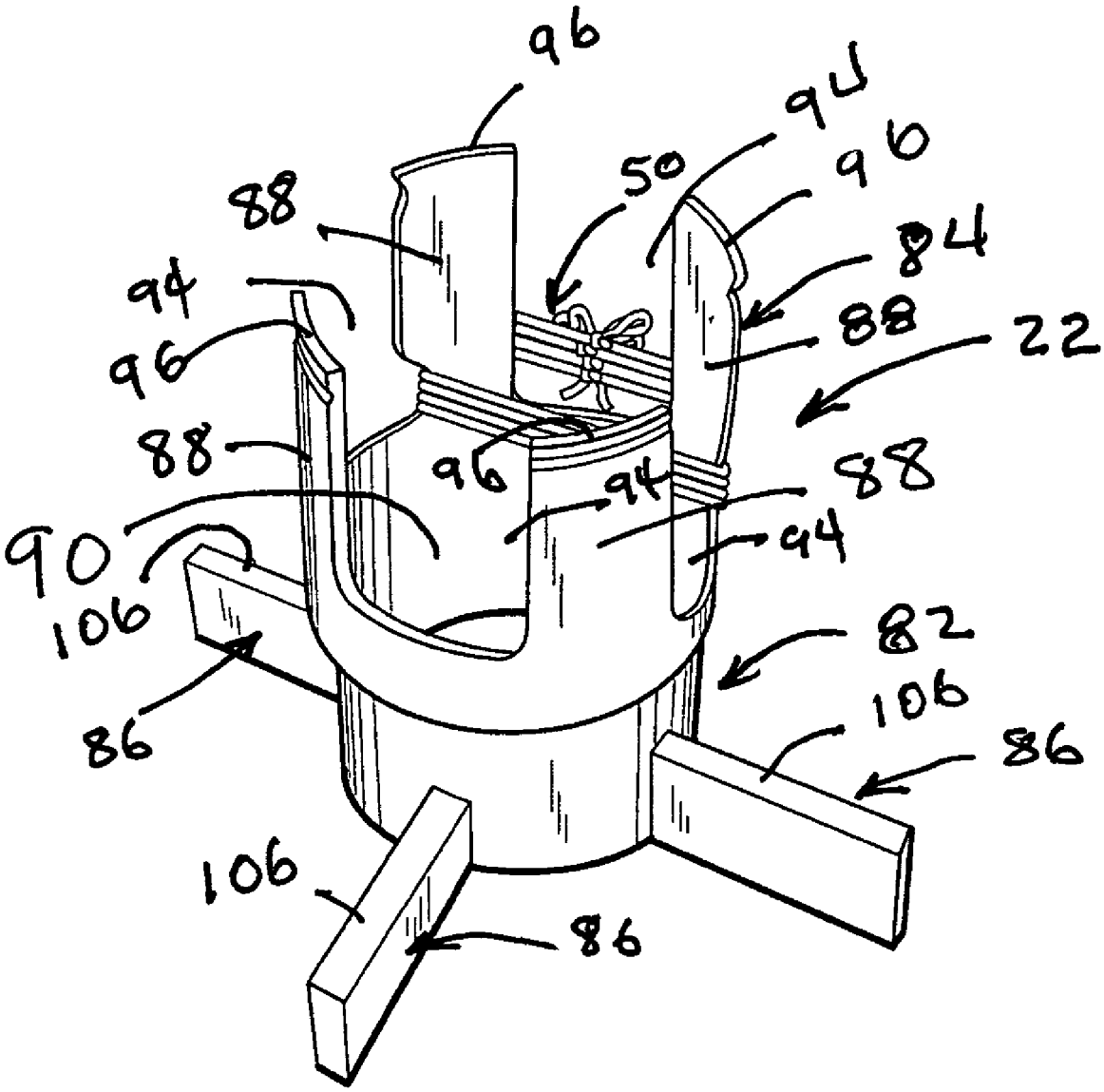
FIG. 4 is a perspective view of the cover forming and banding apparatus removed from the frame assembly of the apparatus of the present invention.

The platform 26 extends outwardly from an upper or second end 40 of the housing 32. The platform 26 is provided with an opening 42 therein which permits access to the well 24 of the frame assembly 20 via the upper or second end 40 (FIGS. 1, 3 and 7) of the housing 32. The platform 26 is further provided with a passageway 44 (FIGS. 1–3, 6 and 7) extending from a peripheral portion 46 of the opening 42 in the platform 26 to an adjacently disposed edge 48 of the platform 26.

The size of the opening 42 in the platform 26 can vary widely, the only requirement being that the opening 42 be of sufficient size to permit the flower pot 18 to be disposed there through and into engagement with the cover forming and banding assembly 22 supported in the well 24 of the frame assembly 20. In addition, the size of the opening 42 is desirably sufficient to also permit interchange of various sizes of the cover forming and banding assembly 22 employed in the practice of the present invention.

Figure 7:
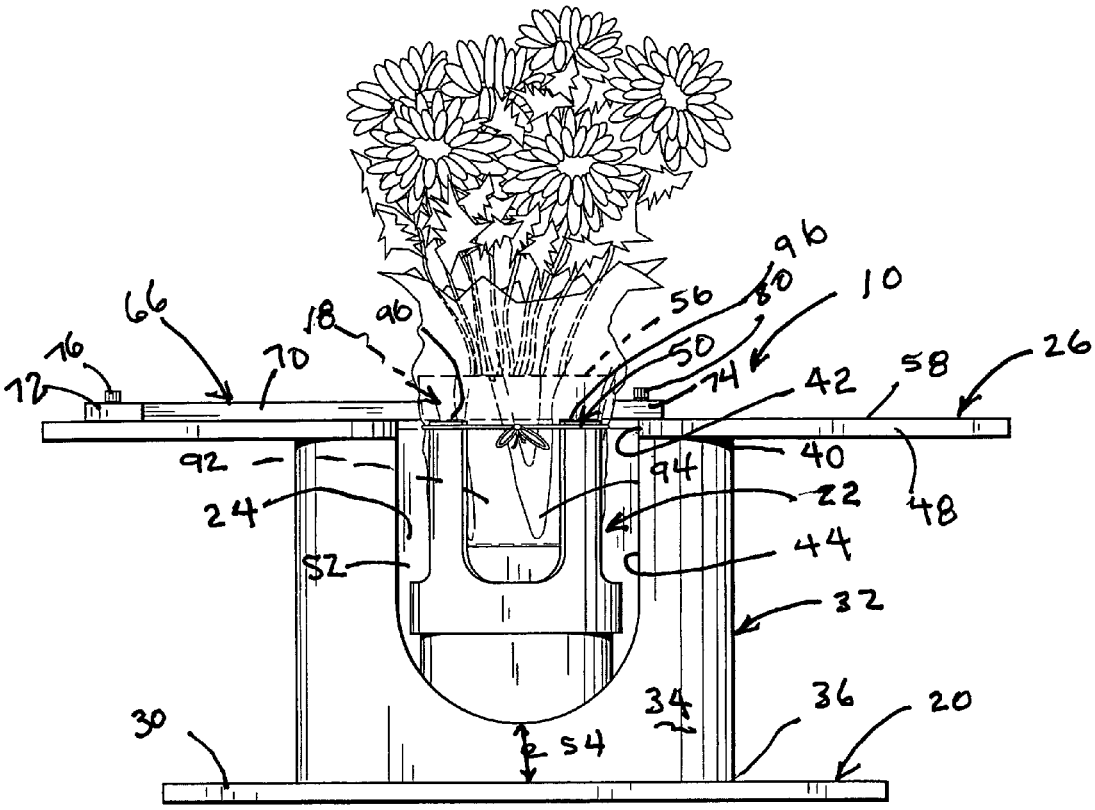
FIG. 7 is side elevational view of the apparatus of FIG. 6 having a flower pot positioned in a cover forming assembly of the cover forming and banding apparatus, the flower pot having a decorative cover formed thereabout and a band positioned on the banding assembly of the cover forming and banding apparatus for positioning about the decorative cover to secure the decorative cover about the flower pot.

To assist an operator in the operation and use of the apparatus 10 for forming the decorative cover 14 about the outer peripheral surface 16 of the flower pot 18, and to secure the decorative cover 14 about the flower pot 18 with at least one band 50, the peripheral side wall 34 of the housing 32 is provided with an opening 52, the opening 52 extending from the upper or second end 40 of the housing 32 and terminating a distance 54 (FIG. 7) from the lower or first end 36 of the housing 32. The opening 52 in the peripheral sidewall 34 of the housing 32 substantially corresponds in width to the width of the passageway 44 formed in the platform 26 of the apparatus 10. Thus, unrestricted access is provided to the well 24 of the frame assembly 20 defined by the housing 32 and a portion of the base plate 30 for permitting an operator to position and secure the cover forming and banding assembly 22 within the well 24 of the frame assembly 20, while at the same time permitting the operator to position at least one band 50 about the decorative cover 14 formed about the outer peripheral surface 16 of the flower pot 18 either above an upper end 56 of the flower pot 18 as shown in FIG. 9, or below the upper end 56 of the flower pot 18 as shown in FIGS. 7 and 10.

The platform 26 is sized to accommodate the sheet of cover forming material 28 thereon (FIG. 6) such that the sheet of cover forming material 28 can be formed into the decorative cover 14 about the outer peripheral surface 16 of the flower pot 18 as shown in FIGS. 9 and 10. Further, the platform 26 has a substantially plainer upper support surface 58 and a plurality of holes 60, 62, and 64 are positioned within the platform 26 for permitting an adjustment of an alignment assembly 66. The platform 26 and the alignment assembly 66 cooperate to position the sheet of cover forming material 28 in the desired position over the well 24 of the frame assembly 20 and thus the cover forming and banding assembly 22 supported in the well 24 of the frame assembly 20.

The alignment assembly 66 is provided with a first leg 68 and a second leg 70. Holes (not shown) are provided in a first end portion 72 of the first leg 68 of the alignment assembly 66, at the interconnection or junction 73 of the first and second legs 68 and 70 and the second end portion 74 of the second leg 70 of the alignment assembly 66. The holes within the alignment assembly 66 are alignable with selected holes of the holes 60, 62 and 64 in the platform 26 so that connectors 76, 78 and 80 can be disposed in the aligned holes in the alignment assembly 66 and the platform 26 for connecting the alignment assembly 66 to the platform 26 and thereby assist in positioning the sheet of cover forming material 28 on the platform 26.

Any suitable connectors can be employed as the connectors 76, 78 and 80 provided such connectors are capable of securing the alignment assembly 66 in a stable position on the platform 26. Thus, the connectors may be a plurality of bolts, nuts and studs extending from a lower surface of the alignment assembly 66 or bolts extending through the alignment assembly 66 but which do not require the use of nuts to secure the alignment assembly 66 in a stable position on the platform 26. It should be also understood that while the alignment assembly 66 has been depicted as a substantially L-shaped member, the alignment assembly 66 may be formed of two or more separate components and in such case the positioning of the holes 60, 62 and 64 in the platform 26 will be varied somewhat to accommodate the configuration of the alignment assembly. Further more, it should be understood that the use of the alignment assembly 66 is not required in the operation of the apparatus 10 but is useful in proper positioning of the sheet of material 28 over the well 24 formed in the frame assembly 20 and over the cover forming and banding assembly 22 supported within the well 24 of the frame assembly 20.

Referring more specifically to FIGS. 1, 2, 4 and 5, the cover forming and banding assembly 22 is supported on the base plate 30 of the frame assembly 20 such that the cover forming and banding assembly 22 extends upwardly therefrom into the well 24 formed by a portion of the base plate 30 and the housing 32 the frame assembly 20. As more clearly shown in FIGS. 1, 4 and 5 the cover forming and banding assembly 22 is provided with a lower portion 82, an upper portion 84 and a plurality of legs 86 extending outwardly from the lower portion 82 for stabilizing the cover forming and banding assembly 22 within the well 24 of the frame assembly 20. The upper portion 84 includes a plurality of upwardly extending, spatially disposed pleat forming members 88. Thus, the pleat forming members 88, the upper portion 84 and the lower portion 22 of the cover forming and banding assembly 22 cooperate to define a pot receiving opening 90 which is size and configured to receive at least a lower portion 92 of the flower pot 18 and a portion of the sheet of cover forming material 28 used to form the decorative cover 14 about the outer peripheral surface 16 of the flower pot 18 as shown in FIG. 7. Because the pleat forming members 88 are spatially disposed relative to one another a space 94 is provided between adjacently disposed pleat forming members 88 which assist in formation of pleats in the decorative cover 14. As can be appreciated, the size of the pleats, as well as the configuration of the pleats, will depend to a large extent upon the size and configuration of the space 94 provided between adjacently disposed pleat forming members 88 of the cover forming and banding assembly 22.

Figure 5:
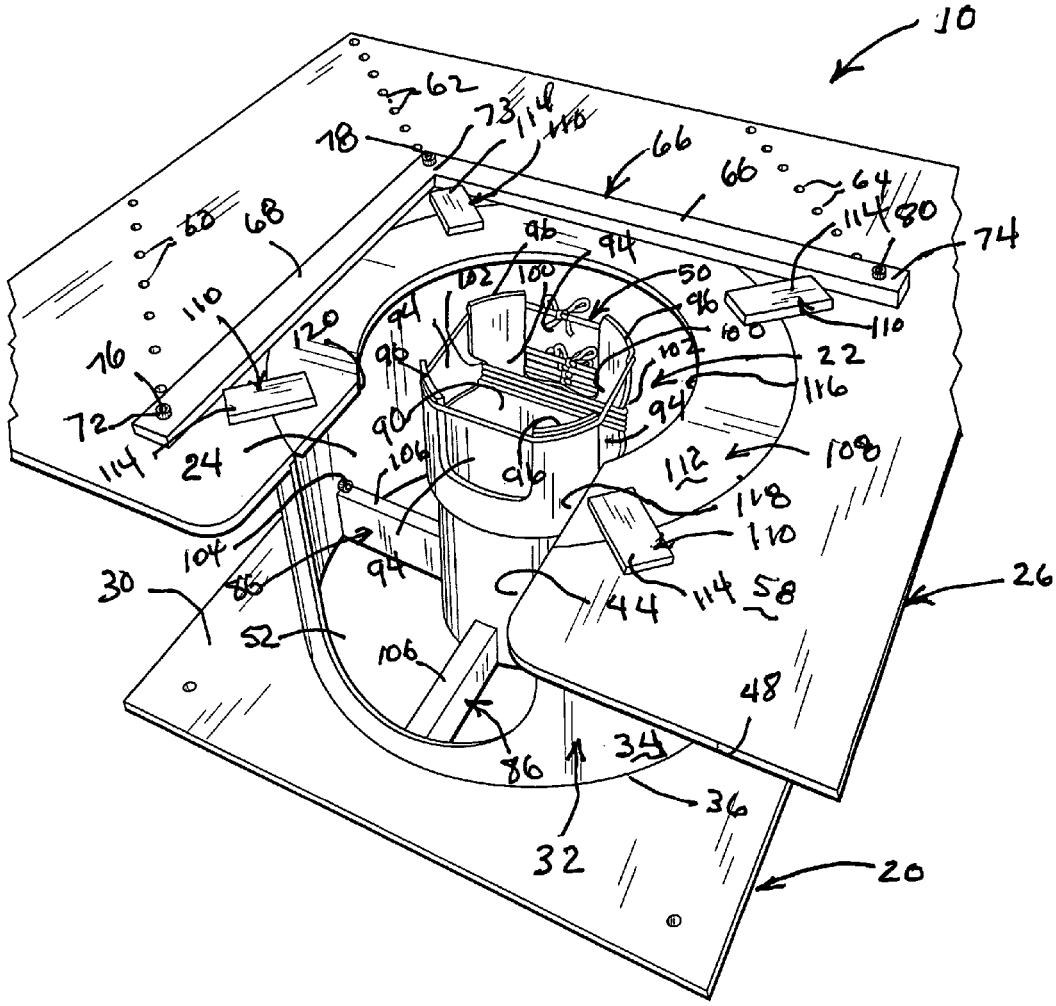
FIG. 5 is a partially broken perspective view of the apparatus of the present invention having the cover forming and banding apparatus supported in the well of the frame assembly and having a platform insert supported by a platform of the apparatus.
Figure 8:
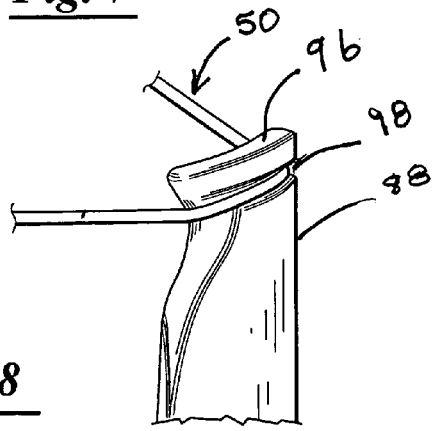
FIG. 8 is a fragmental, perspective view of a band holding member of the banding assembly of the cover forming and banding apparatus.

In order to secure the decorative cover 14 so formed about the outer peripheral surface 16 of the flower pot 18, a distal end 96 of each of the pleat forming members 88 is provided with band engaging portion 98 for stabilizing at least one band 50 thereon (FIG. 8) and for positioning the band 50 in a banding position (FIGS. 1, 5 and 7). A lower end portion 100 of at least two of the pleat forming members 88 is provided with a recess 102 therein for storing a plurality of the bands substantially as shown in FIGS. 1 and 5.

To stabilize and secure the cover forming and banding assembly 22 in position within the well 24 of the housing 32 of the frame assembly 20, a plurality of stabilizing members 104 are connectable to the peripheral sidewall 34 of the housing 32 so as frictionally engage an upper surface 106 of the legs 86 of the cover forming and banding assembly 22 (FIGS. 1–5). The stabilizing members 104 are shown as set screws which are threadably connected to the peripheral sidewall 34 of the housing 32. However, it should be understood that the present invention is not limited to the use of set screws as the stabilizer members 104. That is, any type of connector can employed as the stabilizer members 104 as long as such connectors are capable of securing the cover forming and banding assembly 22 within the well 24 of the frame assembly 20 in a stable position.

Referring now to FIG. 5 the apparatus 10 is shown as further including a platform insert 108 disposed within the opening 42 in the platform 26. The platform insert 108 is provided with plurality of lugs 110 which are connected to an upper surface 112 of the platform insert 108. The lugs 110 are provided with a sufficient length such that a distal end portion 114 of each of the lugs 110 overlays a portion of the platform 26 substantially as shown. The platform insert 108 is provided with a centrally disposed opening 116 which is less in diameter than the opening 42 in the platform 26. The platform insert 108 is further provided with a passageway 118 from a peripheral edge 120 of the opening 116 in the platform insert 108 such that the passageway 118 openly communicates and is substantially aligned with the passageway 44 extending from a peripheral portion 46 of the opening 42 in the platform 26 to adjacently dispose edge 48 of the platform 26. Thus, the platform insert 108 permits one to position a sheet of cover forming material 28 on the platform 26 and the platform insert 108 so that the decorative cover 14 can be formed about the outer peripheral surface 16 of the flower pot 18 having a substantially reduced size, such as forming the decorative cover 14 about a 4 inch flower pot 18. Without the use of the platform insert 108, the size of the sheet of cover forming material 28 used in the formation of the decorative cover 14 may readily fall through the opening 42 in the platform 26.

The term "band" as used herein means any material which may be used to secure the decorative cover 14 about the flower pot 18. Thus, the term "band" included elastic or rubber bands, as well as other types of material such as string, a non-elastic material, a ribbon, a paper strip, a plastic strip, wire, a tie wrap or twist tie, a stribbon, a strip of heat shrinkable material or any other device capable of securing the decorative cover 14 about the flower pot 18 substantially as shown in FIGS. 9 and 10. The term "band" may also include a bow or other decorative components.

Any suitable material capable of being formed about the outer peripheral surface 16 of the flower pot 18 to provide a decorative cover 14 can be employed as the sheet of cover forming material 28. For example, but not by limitation, the cover forming material 28 may be one or more floral sleeves, one or more sheets of material, or any other material capable of being formed into the decorative cover 14 extending about the outer peripheral 16 of the flower pot 18. In addition, the sheet material may include extensions (not shown) which provide the sheet of material with the appearance of being formed of or containing a plurality of sleeves, sheets of cover forming material 28 or other material and the extension may be the same type of material or different types of material than that of the sleeves, the sheets of material or other materials used to produce the decorative cover 14.

In addition, the sheet of cover forming material may be constructed from any suitable material that is capable of being form into the decorative cover 14. For example, the decorative sheet of material may be constructed of paper, foil, cloth (natural or synthetic or combinations thereof), denim, burlap, polymeric film and combination or laminations thereof.

The term "polymeric film" as used herein is to be understood to be either a film synthetic polymeric, such as polypropylene film, or a film of a naturally occurring polymeric material, such as cellophane. The thickness of the sheet of material employed in the practice of the present invention can vary widely but will generally be in the range of from about 0.5 mil. to about 30 mil. and more desirably from about 1 mil. to about 5 mil. When a sheet of material is used to formed the decorative about the outer peripheral surface of the flower pot the one or more sheets of material may be employed to form the decorative cover 14. Further, the sheets of material may have any geometric configuration, such as a square, rectangle, heart shape, octagonal, combinations thereof and the like. In addition, the sheet of material may be formed of one or more sheets of material which are laminated or a plurality of sheets of material may be employed wherein the sheets of material have varying sizes or varying configurations, depending on the overall look desired in the decorative cover 14 formed about the outer peripheral surface of the flower pot from such sheets of material.

Figure 6:
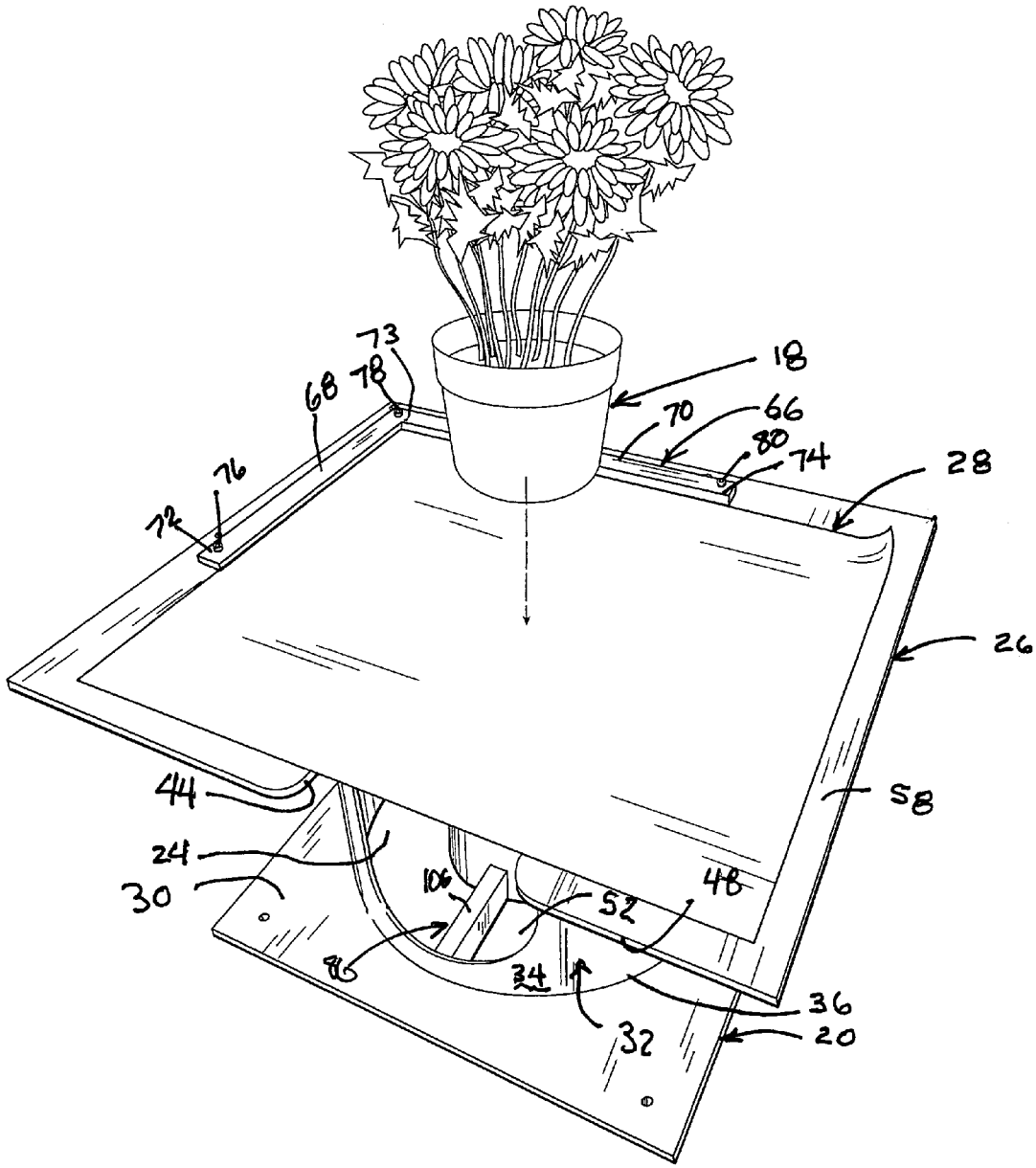
FIG. 6 is a perspective view of the apparatus of FIG. 1 having a sheet of material supported on the platform of the frame so as to be disposed over the well of the frame and thus the cover forming and banding apparatus supported therein, a flower pot being positioned above the sheet of material.

Referring now FIGS. 6 and 7, and prior to forming the decorative cover 14 about the outer peripheral surface 16 of the flower pot 18, the operator of the apparatus 10 positions his hands through the opening 52 formed in the peripheral side walls 34 of the housing 32 or the opening 42 in the platform 26 for positioning one of the bands 50 on the band engaging portions 98 of each of the pleat forming members 88. Thereafter, the operator positions the sheet of cover forming material 28 on the platform 26 of the frame assembly 18 such that the sheet of material extends over the opening 42 in the platform and thus the cover forming and banding assembly 22 supported within the well 24 of the frame assembly 20. The flower pot 18 is then positioned above the sheet of cover forming material 28 and moved in a downwardly direction through the opening 42 in the platform 26 and into engagement with the cover forming and banding assembly 22 (see FIG. 7). While the flower pot 18 having the decorative cover 14 formed thereabout from the sheet of cover forming material 28 is maintained in the cover forming and banding assembly 22, the operator positions his hands through the opening 52 in the peripheral sidewall 34 of the housing 32 and removes the band 50 from the band engaging portion 98 of the pleat forming members 88 whereby the band 50 is disposed about the decorative cover 14 either at a position above the upper end 56 of the flower pot 18 substantially as shown in FIG. 9, or at a position below the upper end 56 of the flower pot 18 substantially as shown in FIGS. 7 and 10.

Changes my be made in the construction and the operation of the various components, elements and assemblies described herein and changes may be made in the steps or the sequence of steps of the methods described herein without departing from the spirit and scope of the invention as defined in the following claims.

What is claimed is:

1. An apparatus for forming and securing a decorative cover about an outer peripheral surface of a flower pot, the apparatus comprising:

a frame assembly having a well formed therein;

a platform connected to the frame assembly, the platform having an opening therein sized to permit passage of at least a portion of a flower pot and at least a portion of a sheet of cover forming material there through;

a cover forming and banding assembly having a flower pot receiving opening sized and configured to receive at least a portion of the sheet of cover forming material and at least a lower portion of the flower pot, the cover forming and banding assembly supported within the well of the frame assembly such that the flower pot receiving opening in the cover forming and banding assembly is aligned with the opening in the platform, the cover forming and banding assembly having a plurality of pleat forming members, each of the pleat forming members having a band-engaging portion for supporting at least one band thereon such that upon forming a decorative cover about an outer peripheral surface of the flower pot by positioning the flower pot and at least a portion of the sheet of cover forming material within the pot receiving opening of the cover forming and banding assembly, the decorative cover so formed is secured about the outer peripheral surface of the flower pot by removing the at least one band from the band-engaging portion of the pleat forming members of the cover forming and banding assembly and positioning the at least one band about the decorative cover.

2. The apparatus of claim 1 wherein the cover forming and banding assembly comprises:

a lower portion having an opening formed therein; and an upper portion, the upper portion defines the plurality of spatially disposed pleat forming members, the plurality of spatially disposed pleat forming members disposed about the opening in the lower body portion and extending in an upwardly direction therefrom, the plurality of spatially disposed pleat forming members cooperating with the opening in the lower body portion to define the flower pot receiving opening in the cover forming and banding assembly.

3. The apparatus of claim 2 wherein the cover forming and banding assembly further comprises a plurality of legs extending outwardly from the lower portion of the cover forming and banding assembly for stabilizing the cover forming and banding assembly in the well of the frame assembly.

4. The apparatus of claim 3 wherein the platform is provided with a passageway extending from the opening therein to an outer peripheral edge of the platform so as to form a passageway to the opening in the platform and wherein the housing is provided with an opening in a peripheral sidewall thereof which is aligned with the passageway formed in the platform for providing unrestricted access to the cover forming and banding assembly supported within the well of the frame assembly.

5. The apparatus of claim 4 wherein a distal end portion of each of the pleat forming members of the cover forming and band assembly defines the band-engaging portion for stabilizing at least one band thereon such that upon positioning at least a portion of the flower pot and the sheet of cover forming material within the pot opening of the cover forming and banding assembly the band can be selectively removed therefrom and positioned about the decorative cover so formed about the flower pot.

6. The apparatus on claim 5 wherein a lower portion of at least two of the pleat forming members of the cover forming and banding assembly is provided with a recess whereby a plurality of bands can be stored on the lower end portion of the at least two pleat forming members.

* * * * *